United States Patent [19]

Emrich et al.

[11] 4,134,582

[45] Jan. 16, 1979

[54] DEVICE FOR THE REGISTERING OF SHEETS IN PRINTING PRESSES IN WHICH THE SHEETS ARE FED IN AN UNDERLAPPED STREAM

[75] Inventors: Helmut Emrich; Paul Abendroth, both of Offenbach am Main, Fed. Rep. of Germany

[73] Assignee: Roland Offsetmaschinenfabrik Faber & Schleicher AG, Fed. Rep. of Germany

[21] Appl. No.: 808,084

[22] Filed: Jun. 20, 1977

[30] Foreign Application Priority Data

Jun. 23, 1976 [DE] Fed. Rep. of Germany ..... 2628122

[51] Int. Cl.[2] ..... B65H 9/00

[52] U.S. Cl. ..... 271/237; 271/244; 271/252

[58] Field of Search ..... 271/236, 237, 238, 243, 271/244, 250, 252, 226

[56] References Cited

U.S. PATENT DOCUMENTS

| | | | |
|---|---|---|---|
| 2,857,160 | 10/1958 | Vandeman | 271/237 |
| 2,857,161 | 10/1958 | Kist | 271/237 |
| 2,937,020 | 5/1960 | Layden | 271/237 |
| 2,984,482 | 5/1961 | Kist | 271/237 X |
| 4,060,237 | 11/1977 | Degen | 271/237 X |

FOREIGN PATENT DOCUMENTS

| | | | |
|---|---|---|---|
| 653308 | 11/1937 | Fed. Rep. of Germany | 271/236 |

*Primary Examiner*—Richard A. Schacher
*Attorney, Agent, or Firm*—Leydig, Voit, Osann, Mayer & Holt, Ltd.

[57] ABSTRACT

A device for registering of sheets, received in an underlapped stream, upon a feed table. The feed table has a retractable front stop and a side guide defining a condition of accurate register for the sheet. Cooperating with the side guide is a wiping mechanism which includes a lower wiping member and a cooperating upper wiping member for engaging a sheet between them for wiping the same into laterally registered position. A pre-gripper grips the leading edge of a registered leading sheet for transporting it forwardly and upwardly to a receiving cylinder thereby forming a wedged-shaped gap above the following sheet. Upon formation of the gap the upper wiping member is momentarily inserted into the gap in active wiping position, with the result that the following sheet is fully registered while it is still partially covered by the leading sheet. The front stop is mounted for swinging movement and so arranged that upon moving to active position it engages the underside of the leading sheet at a point spaced above the table thereby insuring the presence of a well-defined gap for entry by the upper wiping member. In one embodiment of the invention the upper wiping member is mounted upon a rotatable arm for moving the member quickly into and out of the gap while providing a limited amount of dwell in wiping position. In a second embodiment the upper wiping member is mounted upon an arm which reciprocates inwardly and outwardly of the gap.

8 Claims, 5 Drawing Figures

DEVICE FOR THE REGISTERING OF SHEETS IN PRINTING PRESSES IN WHICH THE SHEETS ARE FED IN AN UNDERLAPPED STREAM

In the feeding of sheets singly across a feed table into a registered position for pickup, side register presents no problem since the sheet can be engaged on its opposite sides by cooperating wiping or "clamping" members which act together to nudge the sheet in the direction of the side guide. However, in the case of presses intended for operation at higher speeds, where the sheets are fed across the feed table in an "underlapped" stream, with each sheet projecting under the sheet ahead of it, the top surface of the sheet which is to be registered is partially covered by the preceding sheet so that the top surface is not available for wiping engagement. Thus consideration has been given to dispensing with an upper wiping member; for example, in German Pat. No. 583,244 means are shown for engaging a sheet solely by a sucker on the underside. However it has been found that use of underside suckers is accompanied by a number of serious disadvantages.

Accordingly, as shown in German Pat. No. 1,159,967, it has been proposed to provide an upper clamp in the form of a sharpened blade for insertion between a registered leading sheet and a following sheet, with the blade serving as a backstop for a lower wiping member in the form of a roller. This, however, requires the registered leading sheet to be lifted at its edge by the blade which tends to destroy the condition of accurate register, especially in presses operating at maximum speed. Consistent location of the point of separation also presents a problem.

In view of the difficulty in obtaining access to the top of the following sheet, where sheets are fed in an underlapped stream, it has been proposed to intentionally shift the leading sheet after its alignment but before pickup thereby to expose the lateral edge of the following sheet for engagement by wiping means in the conventional way; see, for example, German Pat. Nos. 653,308 and 2,063,818. The problem with this procedure is that a sheet, after alignment, must be subjected to an additional motion.

It is, accordingly, an object of the present invention to provide lateral wiping engagement of both sides of the bottom, or "following" sheet fed in an underlapped series to obtain precise lateral register and which is free of the problems of known prior art arrangements intended for the same purpose.

It is another object of the invention to provide a sheet registering arrangement which utilizes a pre-gripper for gripping the leading edge of a registered leading sheet and for transporting it forwardly and upwardly into engagement with the grippers on a receiving cylinder thereby creating a wedge-shaped gap above the following sheet, with the upper wiping member being synchronously interposed in the gap for performance of the lateral wiping function.

It is still another object of the present invention to provide a construction in which the front stop is so constructed and mounted that upon movement into active position, it engages the underside of the leading sheet above the level of the table, thereby insuring the presence of a well-defined gap for entry by the upper wiping member. In addition, entry of the upper wiping member is facilitated by providing a tapered "nose" thereon, further insuring entry into the gap.

It is a general object of the present invention to provide a device for the successive registering of a stream of underlapped sheets which is capable of securing accurate register at the highest press speeds and in which the condition of register is accurately maintained from the time that the sheet leaves its registering position to the time that the sheet is gripped by the grippers on the receiving cylinder.

It is a general object of the invention to provide a registering means which is positive and reliable in operation but which, nevertheless, is simple and economical in construction and which does not require a high order of accuracy of timing or synchronization and in which the original adjustment is maintained without care or attention on the part of the operator over long press runs.

Other objects and advantages of the invention will become apparent upon reading the attached detailed description and upon reference to the drawings in which.

While the invention has been described in connection with certain preferred embodiments, it will be understood that there is no intention to limit the invention to the embodiments shown but it is intended, on the contrary, to cover the various alternative and equivalent constructions included within the spirit and scope of the appended claims.

Figure 1:
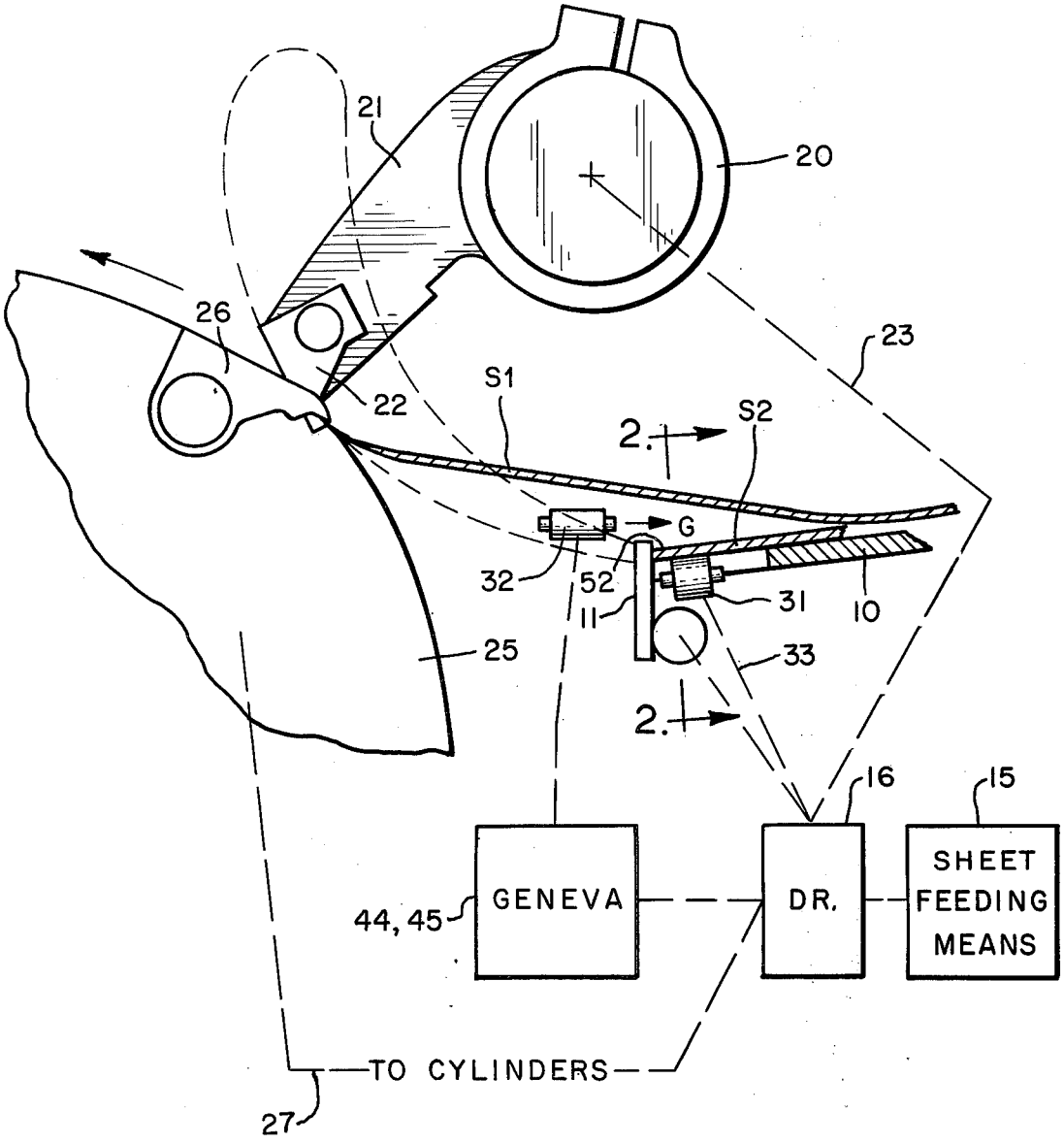
FIG. 1 is a fragmentary side elevation showing the feed table, pre-gripper and impression cylinder and relating the wiping means thereto.
Figure 2:
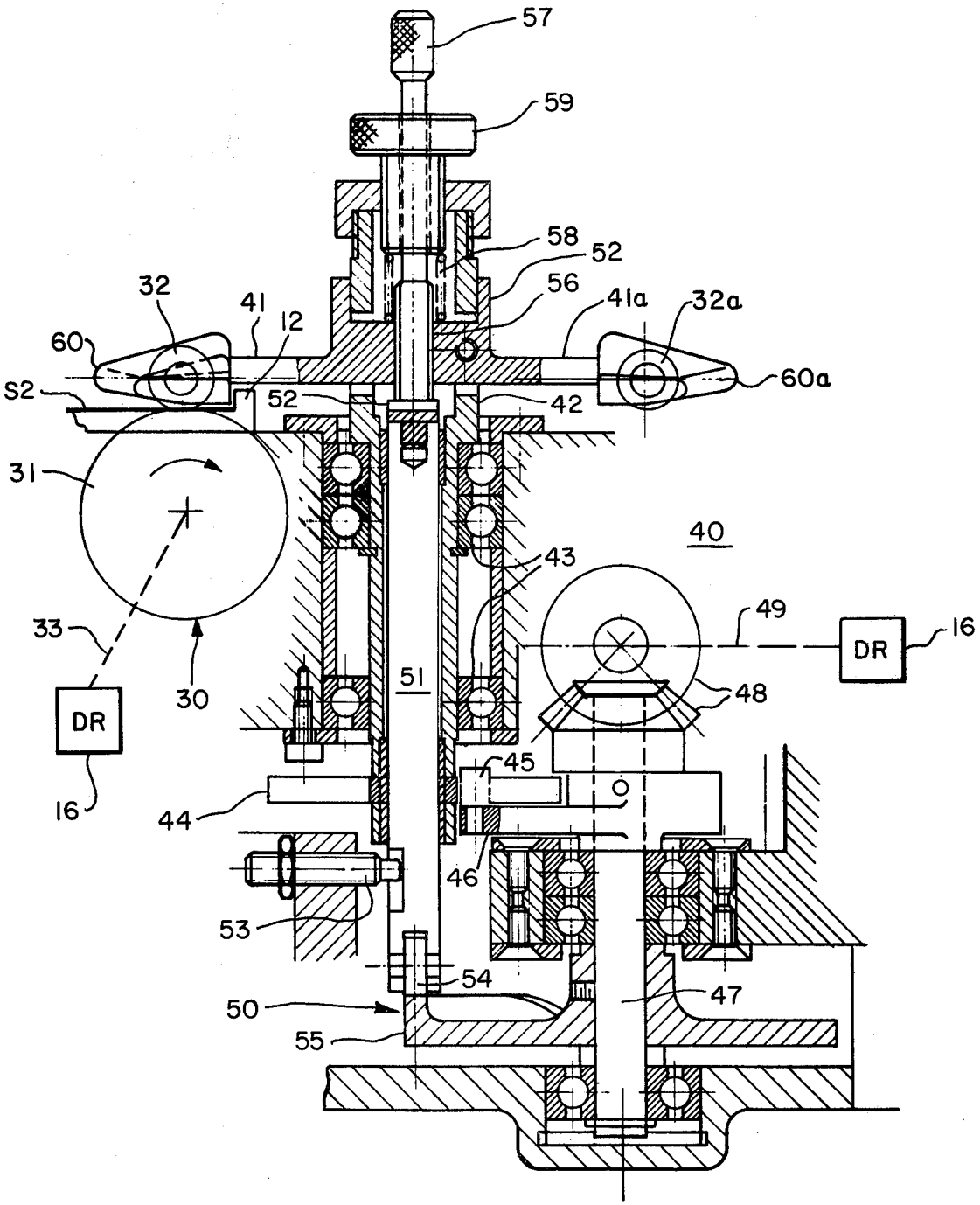
FIG. 2 is a sectional view showing the wiping mechanism and the interposing means for the upper wiping member as viewed approximately along line 2—2 in FIG. 1.

Turning now to FIGS. 1 and 2 there is illustrated the lower end of a feed table 10 having a front stop 11 and a side guide 12. Sheets are fed downwardly (to the left, FIG. 1) across the table by appropriate sheet feeding means 15, well known in the art and hence shown only diagrammatically, powered from the press drive 16.

In carrying out the present invention, sheets are fed across the feed table in an "underlapped" stream, with each sheet projecting under the sheet ahead of it. Portions of two sheets have been illustrated in FIG. 1, a "leading" sheet S1 and a "following" sheet S2.

A sheet is considered to be registered for pickup when it engages both the front stop 11 and side guide 12. As pictured in FIG. 1, the leading sheet S1 has been registered and is shown in the process of being transferred from the feed table to a receiving cylinder by a mechanism, per se well known in the art, referred to as a "pre-gripper" 20. The latter has an arm 21 with a gripper 22 at the end thereof and is mechanically coupled to the press drive 16 via an oscillatory drive connection 23. The pre-gripper in the present instance passes the leading sheet to an impression cylinder 25 having grippers 26 and rotated by a drive connection 27 to the press drive. With regard to the means for timingly operating the grippers 22, 26, such means is per se well known, reference being made to the prior art. It will suffice to say that the pre-gripper grips the leading edge of the sheet at the table, the front stop being retracted, causing the sheet to be transported forwardly and upwardly into engagement with the grippers 26 on the impression cylinder whereupon the pre-grippers 22 are released, with the pre-grippers returning to the table to pick up the next registered sheet in the stream. Since all of the movable elements are coupled to, and hence in synchronism with, the press drive 16, the cycle may be rapidly and accurately repeated.

In accordance with the present invention a wiping mechanism is provided including a lower wiping member and a cooperating upper wiping member for engaging a sheet between them for wiping it against the side guide, the swing axis of the pregripper being located in generally vertical alignment with the front edge of the table (see FIG. 1) so that a wedge-shaped gap G is formed above the following sheet, with means for synchronously interposing the upper wiping member in active wiping position within the gap, with the result that the following sheet is fully registered against the side guide, as well as the front stop, while it is still partially covered by the leading sheet.

Figure 3:
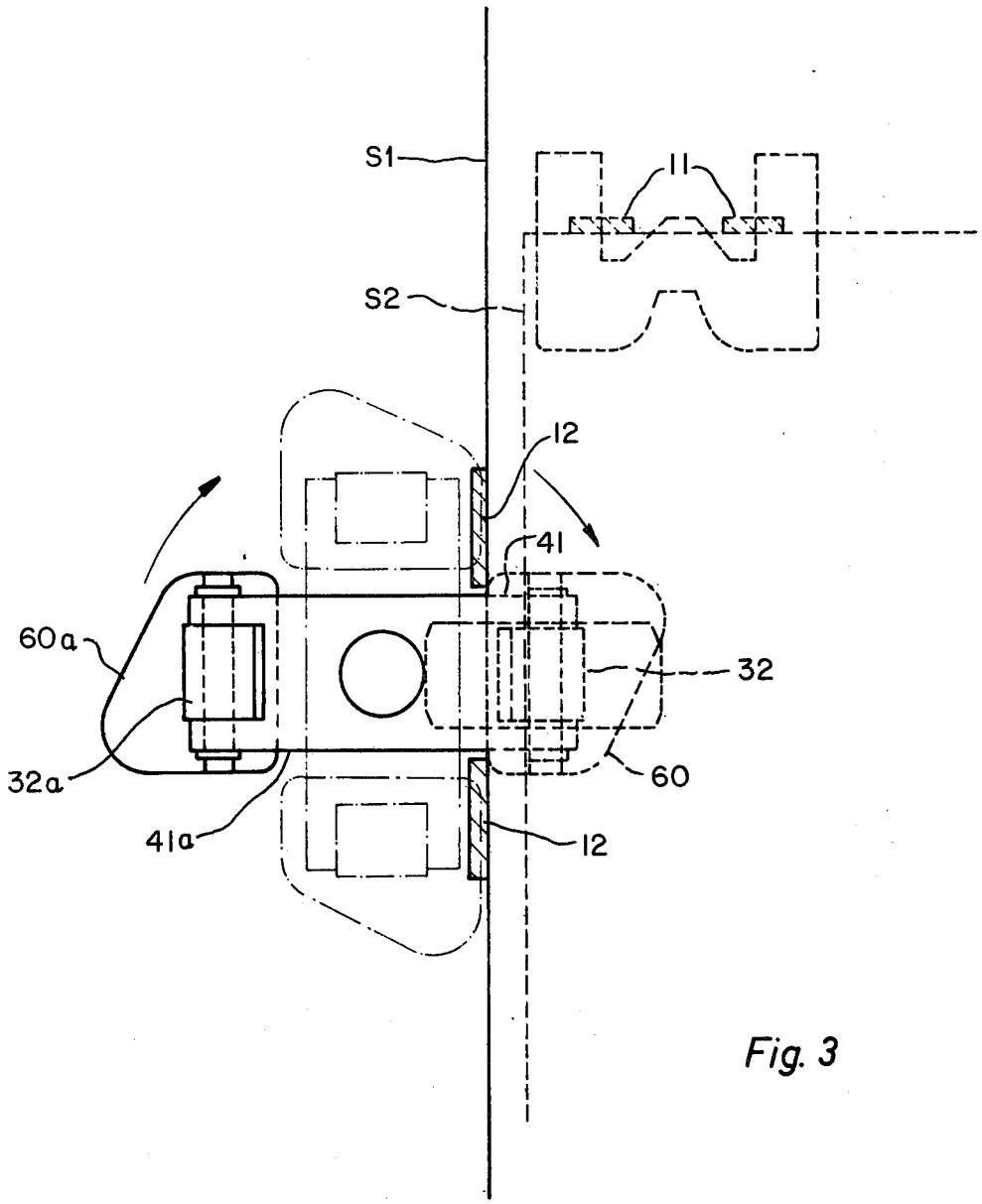
FIG. 3 is a simplified top view of the mechanism of FIG. 2.

Thus, turning to FIGS. 2 and 3 of the drawings, the wiping mechanism, indicated at 30, includes a lower wiping member 31 and an upper wiping member 32 in the form of a pair of rollers, the lower wiping member being coupled via a connection 33 to the press drive 16 for constant rotation in a direction to wipe an engaged sheet in the direction of the side guide 12. The upper wiping member 32 is in the form of an idler of relatively small diameter which serves to clutch the sheet to the lower member by pressing down upon it. Since the sheet, upon being engaged by the two wiping members simultaneously is momentarily clamped between them, the members 31, 32 may be referred to as lower and upper "clamps".

For the purpose of periodically and momentarily rotating the upper wiping member 32 into active position in the gap G, the wiping mechanism includes an interposing device 40 (FIG. 2) having a horizontally rotatable arm 41, in the plane of the gap, to which the roller 32 is secured at its outer end, the axis of the roller being perpendicular to the arm. The arm is carried on a hollow rotatable main shaft 42 journaled in bearings 43 and having, at its lower end, a Geneva mechanism including a Geneva wheel 44 engaged by a pawl 45. The pawl is secured to the end of an arm 46 integral with a vertical drive shaft 47 driven by angle gears 48 which have a connection 49 to the press drive 16. The connection 49 establishes proper phasing so that the upper wiping member rapidly rotates into the gap G into wiping position as the gap is created, remaining there for a short period of dwell sufficient to achieve lateral register, and then is rapidly withdrawn as is characteristic of a Geneva movement.

For the purpose of lowering the upper wiping member 32, into engagement with the sheet during the dwell period and to provide subsequent disengagement, a reciprocating mechanism 50 is provided which includes a push rod 51 mounted for reciprocation within the drive shaft 42. The push rod has a coupling 52 at its upper end for transmitting axial movement to the arm 41 and at the point of exit from the shaft 42 engages a stationary key 53 to prevent rotation. At its lower end the push rod carries a cam follower 54 which rides along the edge of a crown-type cam 55 which is mounted for rotation on the drive shaft 47. The cam is so profiled that the upper wiping member 32 is kept in an upraised, inactive position until the wiping member is fully inserted, that is, until the arm 41 is at right angles to the side guide 12, whereupon the upper wiping member 32 is lowered, during a brief period of dwell, into engagement with the sheet, following which the wiping member is raised in readiness for the final outward swinging movement by the Geneva mechanism. The cam profile necessary to achieve such sequence of events is well within the skill of the art.

Means are provided for adjusting the upper wiping member 32 for various thicknesses of paper and for determining the downward pressure which is exerted during the wiping movement. Height adjustment is brought about by a jack screw 56 having an adjusting knob 57, while downward pressure exerted by a spring 58 is under the control of a threaded bushing 59.

As a result of the use of a Geneva type movement providing a short but well defined period of dwell, and as a result of the precise synchronization of the raising and lowering movements of the wiper, the sheet is only engaged while the arm 41 is at right angles to the sheet and side guide so that there is no component wiping movement either toward or away from the direction of the front stop. As a result the mechanism may be so timed as to permit settling of the sheet against the front stop just slightly before the lateral wiping occurs. Since the wiping movement is precisely parallel to the front stop, the registered condition of the leading edge of the sheet is unaffected.

In order to facilitate entry of the upper wiping roller 32 into the gap G, the arm 41 is provided with a wedge-shaped "nose" 60 adjacent the roller in the form of a light sheet metal mantle which is tapered in the direction of entry.

It is one of the features of the present invention that more than one upper wiping member is provided cooperating with a single lower wiping member. Thus a second roller **32*a*, is provided, mounted upon an arm 41*a* diametrically opposed to the arm 41, and with the roller 32*a* having an associated nose 60*a* identical in structure and function to the nose 60. As a result of the use of two arms, 41, 41*a***, the upper wiping member need only move half as far between its active and retracted positions; in other words, indexing speed and movement may be cut in half while achieving the same operating rate, thereby increasing reliability and reducing the wear and tear upon the mechanism.

While the upper wiping members 32, **32*a* have been described as freely rotatable idler rollers, and while such construction is preferred, it will be understood that such wiping members need not, in fact, be rotatable in order to practice the present invention; for example, the members may be fixed to their respective arms and the present bearing surfaces thereof may be polished to enable a backup force to be applied against the lower roller 31** so that the latter performs its wiping function with intentional slippage at the upper surface.

While the invention has been described in connection with an interposing mechanism providing rotary entry and exit of the upper wiping member, the invention is not limited thereto and the upper wiping member may be reciprocated into and out of wiping position as set forth in FIGS. 4 and 5. In this version of the invention, indicating generally at 70, the lower wiping member is in the form of a driven roller 71 while the upper wiping member is in the form of an idler roller 72, the roller 71 being driven by a connection 73 including angle gears 74 to the press drive 16. The interposing means for the upper wiping member 72 is in the form of a horizontal reciprocating arm 75 having a "nose" 76. The arm is reciprocated in synchronized fashion by a rocker arm 80 having a lower stationary pivot 81, a central driving pivot connection 82 and an upper pivot connection 83 which is pinned to the arm.

Pinned to the drive connection 82, and extending horizontally therefrom, is a follower member 84 carrying a follower roller 85 and terminating in a fork 86. The follower roller bears against the surface of a rotary cam 87, being biased in the direction of the cam by a coil spring 88. The cam has a shaft 89 which serves to support the fork 86 and which is rotatably coupled, through a connection 90, to the press drive 16.

As a result of the "egg" shape of the cam, the reciprocating arm 73 is rapidly inserted and withdrawn, with a brief dwell period being provided between the insertion and withdrawal during which the upper wiping member 72 is lowered into engagement with the sheet. For lowering the upper wiping member 72 into engagement during the period of dwell, corresponding to maximum insertion, the horizontal arm 75 is mounted for slight teeter-totter action upon the pivot 83, vertical movement being imparted to the outer end of the arm by a cam and cam follower. Thus the outer end of the arm 75, indicated at 75*a*, carries a cam follower roller 95 which rides between opposed cam, or way, surfaces 96. The surfaces are so formed that the arm 75 is rocked clockwise through a shallow angle as it approaches the end of its forward stroke, with the motion being reversed upon retraction.

In accordance with one of the aspects of the present invention the front stop 11 is preferably of the composite hold-down type having sequentially retracted hold-down and stop elements, with the hold-down element being mounted for swinging movement about an axis parallel to, and under, the front edge of the table, and with the hold-down element being so shaped and centered that the upper edge thereof upon moving into active position engages the underside of the leading sheet at a point spaced above the table, thereby insuring the presence of a well-defined gap for entry by the upper wiping member. Thus, referring to FIG. 4, the front stop mechanism, generally indicated at 11, includes a stop member 100 mounted upon an arm 101 secured to a rockable shaft 102 which has a rocking connection 103 with the press drive 16. Cooperating with the stop element 100 is a swingable hold-down element 105 mounted upon an arm 106 secured to a shaft 107 having a rocking connection 108 with the press drive. The hold-down member 105 is rockable about an axis 110 which lies parallel to, and under, the front edge of the table so that the tip thereof, upon moving into active position, sweeps a radius R, during which the underside of the leading sheet S1 is engaged, thereby insuring the presence of a well defined gap G for entry by the nose 76 and associated upper wiping member 72. Engagement of the underside of the sheet by the hold-down element does not affect a condition of register since at this time the sheet is under the direct control of the grippers.

As in the rotating-arm embodiment of the invention, means are provided in the reciprocating arm for adjusting the upper wiping member 72 for various thicknesses of paper and for various downward pressures exerted during the wiping movement. Such means are represented in FIG. 5 by a hinge 111 that allows the wiping and outer ends of arm 75 to be set at a slight angle to each other. Thus, the wiping member 72 can be set to various heights by adjusting a screw 112, which determines the angle between the two ends of the reciprocating arm 75. Downward pressure is exerted through a spring 113 adjusted by a threaded member 114.

Figure 4:
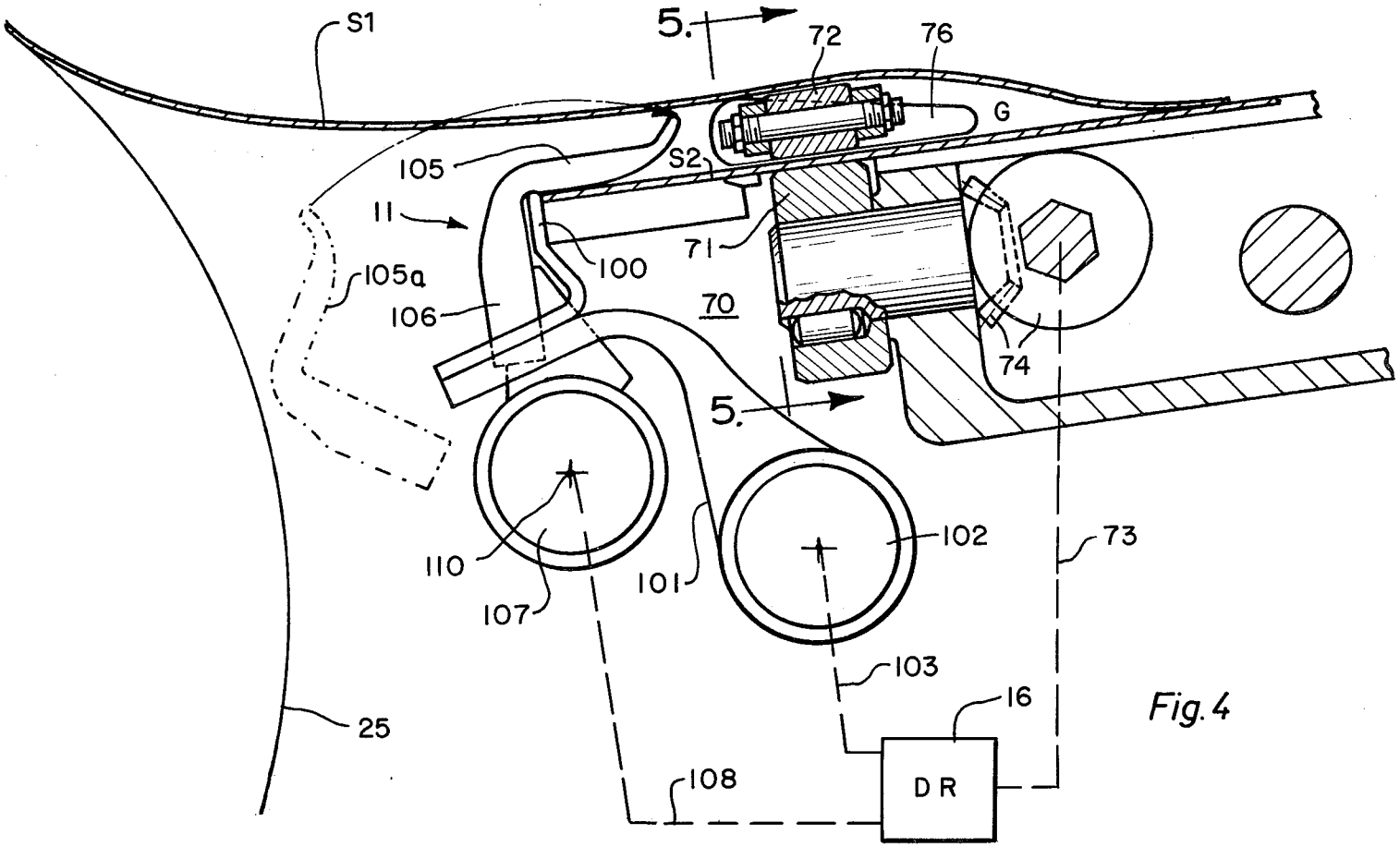
FIG. 4 is a fragmentary elevational view similar to FIG. 1, and in partial section, but showing a modified form of the invention, looking along line 4—4 in FIG. 5.
Figure 5:
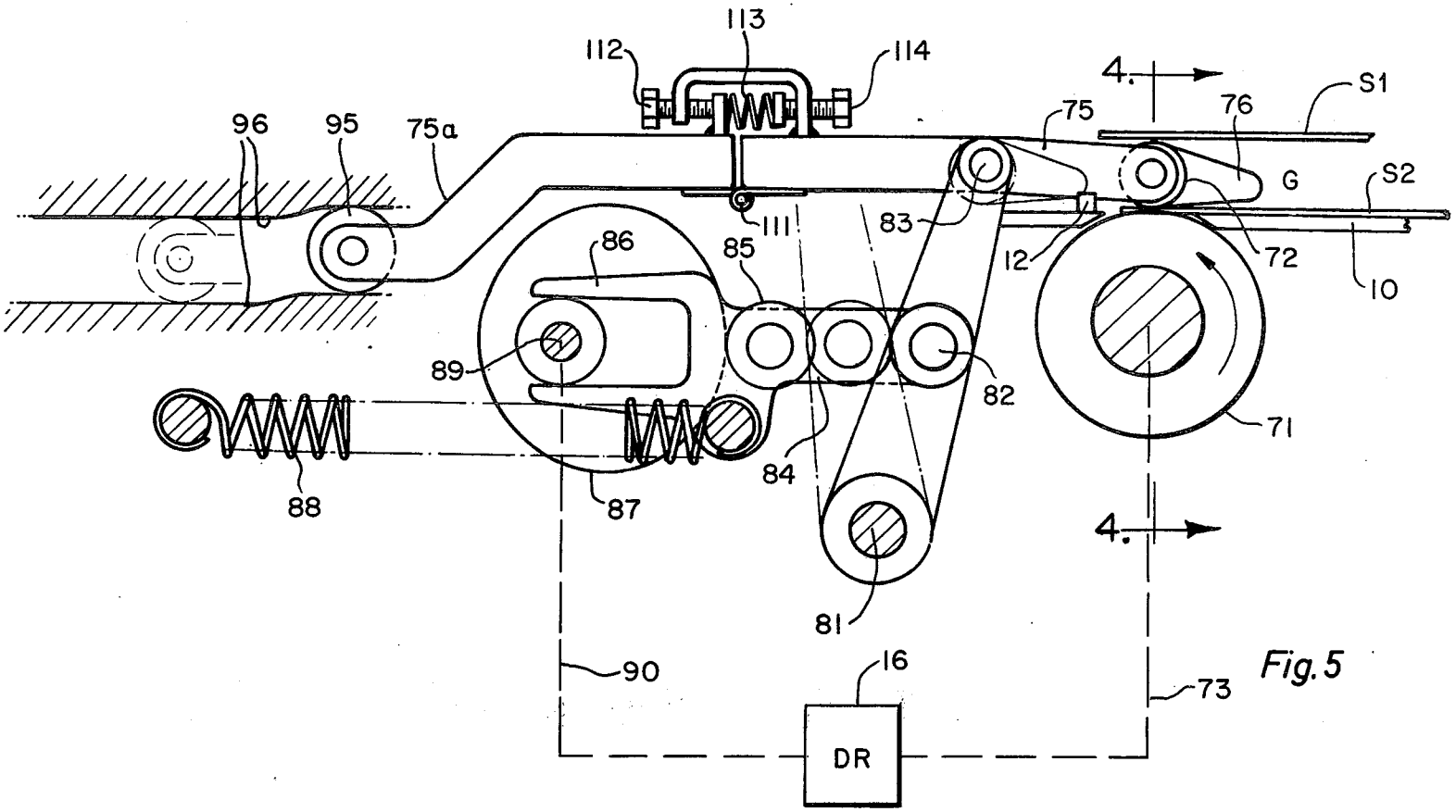
FIG. 5 is a fragmentary section looking along the line 5—5 in FIG. 4.

Thus in a typical operating cycle of a mechanism of FIGS. 4 and 5 it will be assumed that the leading sheet S1 has been registered and that the interposing arm 75 has been retracted to the position shown by the dot-dash lines in FIG. 5. It will also be assumed that the hold-down element 105 is being, or has been, retracted to the dot-dash position illustrated in FIG. 4. At that instant the leading edge of the sheet is engaged by the pre-gripper, accompanied by slight downward movement of the stop element 100, thereby freeing the sheet for forward and upward swinging into the position illustrated in FIG. 4. As soon as the pre-gripper 21 has cleared the front edge of the table, the hold-down element 105 of the front stop swings to the right at a radius R, incident to which the tip of the hold-down sweepingly engages the underside of the sheet S1 thereby further opening the gap G and insuring that an adequate gap is provided for safe and positive entry of the arm 75 and the upper wiping member 76 thereon.

At the point of maximum inward extension of the arm 75 the cam follower roller 95 at the rear end thereof rides upwardly, thus rocking the arm clockwise about pivot 83 and lowering the upper wiping member 72 into engagement with the lower wiping member 71 so that the sheet is, by the latter, wipingly urged in the direction of the side guide 12. Such wiping action, it is to be noted, occurs during the time that the following sheet S2 is still partially covered by the leading sheet S1.

It will be understood that while the composite hold-down type of front stop has been specifically illustrated only in connection with the second embodiment of the invention, it is equally applicable to use with the first embodiment illustrated in FIGS. 1–3 and the same operating sequence applies.

We claim as our invention:

1. A device for the registering of sheets to be printed, the sheets being fed in an underlapped stream with each sheet projecting under the sheet ahead of it, comprising, in combination, a press drive, a feed table, means coupled to the drive for feeding the stream of sheets to the front of the table, a retractable front stop at the front edge of the table, means coupled to the drive for activating the front stop synchronized with the arrival of a sheet, a side guide adjacent the front portion of the table, the front stop and side guide defining a condition of accurate register for the sheet, a wiping mechanism adjacent the side guide including a lower wiping member and a cooperating upper wiping member for engaging a sheet between them for wiping the same into a laterally registered position against the side guide, a receiving cylinder coupled to the drive having grippers and spaced from the front edge of the table, a pre-gripper having a swing axis and coupled to the drive for gripping the leading edge of a registered leading sheet and for transporting it forwardly and upwardly into engagement with the grippers on the receiving cylinder accompanied by passage of the following sheet into a position approaching register at the front of the table, the pre-gripper swing axis being in generally vertical alinement with the front edge of the table so that a wedge-shaped gap is formed above the following sheet, interposing means including an arm in the plane of the gap coupled to the drive and mounted for movement from a retracted position momentarily to an active wiping position synchronized with the creation of the gap, the upper wiring member being in the form of a small diameter idler roller mounted at the end of the arm for rotation about an axis perpendicular to the arm.

2. The combination as claimed in claim 1 including a wedge-shaped nose member at the end of the arm adjacent the roller, the nose member being tapered in the direction of entry and flaring to substantially the diameter of the idler roller for facilitating entry of the roller into the gap between the sheets.

3. A device for the registering of sheets to be printed, the sheets being fed in an underlapped stream with each sheet projecting under the sheet ahead of it, comprising, in combination, a press drive, a feed table, means coupled to the drive for feeding the stream of sheets to the front of the table, a retractable front stop at the front edge of the table, means coupled to the drive for activating the front stop synchronized with the arrival of a sheet, a side guide adjacent the front portion of the table, the front stop and side guide defining a condition of accurate register for the sheet, a wiping mechanism adjacent the side guide including a lower wiping member and a cooperating upper wiping member for engaging a sheet between them for wiping the same into a laterally registered position against the side guide, a receiving cylinder coupled to the drive having grippers and spaced from the front edge of the table, a pre-gripper coupled to the drive for gripping the leading edge of a registered leading sheet and for transporting it forwardly and upwardly into engagement with the grippers on the receiving cylinder accompanied by passage of the following sheet into a position approaching register at the front of the table and so that a wedge-shaped gap is formed above the following sheet, interposing means coupled to the drive for mounting the upper wiping member for movement synchronized with the creation of the gap from a retracted position momentarily to an active wiping position within the gap for lateral wiping of the following sheet with the result that the following sheet may be fully registered against the front stop and side guide while still partially covered by the leading sheet, the front stop being of the composite hold-down type having sequentially retracted hold-down and stop elements, the hold-down element being mounted for swinging movement about an axis parallel to and under the front edge of the table, the hold-down element being so shaped and centered that the upper edge thereof upon moving into active position engages the underside of the leading sheet at a point spaced above the table, thereby insuring the presence of a well-defined gap for entry by the upper wiping member.

4. A device for the registering of sheets to be printed, the sheets being fed in an underlapped stream with each sheet projecting under the sheet ahead of it, comprising, in combination, a press drive, a feed table, means coupled to the drive for feeding the stream of sheets to the front of the table, a retractable front stop at the front edge of the table, means coupled to the drive for activating the front stop synchronized with the arrival of a sheet, a side guide adjacent the front portion of the table, the front stop and side guide defining a condition of accurate register for the sheet, a wiping mechanism adjacent the side guide including a lower wiping member and a cooperating upper wiping member for engaging a sheet between them for wiping the same into a laterally registered position against the side guide, a receiving cylinder coupled to the drive having grippers and spaced from the front edge of the table, a pre-gripper coupled to the drive for gripping the leading edge of a registered leading sheet and for transporting it forwardly and upwardly into engagement with the grippers on the receiving cylinder accompanied by passage of the following sheet into a position approaching register at the front of the table and so that a wedge-shaped gap is formed above the following sheet, interposing means coupled to the drive for mounting the upper wiping member for movement synchronized with the creation of the gap from a retracted position momentarily to an active wiping position within the gap for lateral wiping of the following sheet with the result that the following sheet may be fully registered against the front stop and side guide while still partially covered by the leading sheet, the interposing means including a rotatable arm, the upper wiping member being in the form of a bearing surface at the end of the arm, and means including a Geneva mechanism outboard of the table for mounting the arm for rotation in a plane coinciding with the gap, the Geneva mechanism being phased to move the wiping member quickly into and out of the gap while providing a limited amount of dwell when the wiping member is substantially directly opposite the side guide.

5. The combination as claimed in claim 4 in which means are provided for momentarily lowering the arm timed with the dwell to bring the upper wiping member into cooperative engagement with the lower wiping member.

6. The combination as claimed in claim 4 in which the upper wiping member is in the form of a roller having an axis perpendicular to the arm.

7. The combination as claimed in claim 4 in which the arm is formed with at least two radially extending portions each of which carries an upper wiping member, the upper wiping members being located in the said plane.

8. The combination as claimed in claim 4 in which the upper wiping member has an associated tapered nose of wedge shape for leading the wiping member into the gap.

* * * * *